US005632054A

United States Patent [19]

Hutton et al.

[11] Patent Number: 5,632,054

[45] Date of Patent: May 27, 1997

[54] MATTRESS HANDLE STRUCTURE

[76] Inventors: William B. Hutton; Deanice B. Hutton, both of 330 Riverside Dr., St. Helens, Oreg. 97051

[21] Appl. No.: 682,843

[22] Filed: Jul. 12, 1996

[51] Int. Cl.[6] ..... A47C 21/02; A47C 31/08

[52] U.S. Cl. ..... 5/692; 5/703

[58] Field of Search ..... 5/703, 704, 692, 5/639, 496, 498; 24/72.5

[56] References Cited

U.S. PATENT DOCUMENTS

| | | | |
|---|---|---|---|
| 1,035,222 | 8/1912 | Minchin | 5/703 |
| 2,715,229 | 8/1955 | Hirschman | 5/703 |
| 4,660,240 | 4/1987 | Hutton et al. | 5/498 |
| 4,782,543 | 11/1988 | Hutton et al. | 5/498 |
| 4,862,541 | 9/1989 | Hutton et al. | 5/496 |
| 5,161,276 | 11/1992 | Hutton et al. | 5/498 |

FOREIGN PATENT DOCUMENTS

| | | | |
|---|---|---|---|
| 176966 | 7/1935 | Switzerland | 5/703 |

*Primary Examiner*—Alexander Grosz
*Attorney, Agent, or Firm*—Smith-Hill and Bedell

[57] ABSTRACT

A mattress has a corner at which two edges of the wall of the mattress meet. A handle has two end regions attached to the two edges respectively of the mattress wall adjacent the corner and has a medial portion that wraps around the corner. An elastic cord has two end regions attached to the two end regions respectively of the handle and has a medial portion that wraps around the corner of the mattress with the medial portion of the handle between the mattress and the medial portion of the cord. A gripper plate is attached to the plastic cord for securing a sheet or blanket to the mattress.

5 Claims, 3 Drawing Sheets

MATTRESS HANDLE STRUCTURE

BACKGROUND OF THE INVENTION

This invention relates to a mattress handle structure.

A conventional rectangular mattress in twin, full, queen or king size has first and second main surfaces and a wall that joins the first and second main surfaces and has four length segments that meet in pairs at respective corners of the mattress. The mattress has two longer sides and two shorter ends. Depending on the orientation of the mattress, one of the main surfaces is the top surface and the other is the bottom surface, and one of the two ends is the head of the mattress and the other end is the foot of the mattress.

For years, innerspring and foam mattresses were manufactured in twin, double, queen, and king sizes having fairly standard dimensions. In capturing the luxury market driven by demand for greater comfort and superior back support, mattresses that are higher or thicker than older conventional mattresses, some with additional quilted padding on the top and bottom, are being made available by manufacturers. While older conventional mattresses were approximately 7 inches thick, these newer mattresses can be up to 16 inches thick.

Bed clothing, particularly fitted sheets and mattress pads, designed to be used on the older conventional style of mattress, do not fit new, thicker mattresses. The corners of fitted sheets cannot fit over the bottom edges of thicker mattresses. Even flat sheets, if manufactured for use on the older mattresses, will seem skimpy when tucked under the edges of a new, thicker mattress. Neither an older fitted sheet nor an older flat sheet will remain properly in place on a new, thicker mattress. Therefore, when contemplating the purchase of a new mattress, it becomes necessary for the potential customer to consider the possibility that purchasing a new mattress will also require purchasing all new bed linens. This added cost could dissuade some people from purchasing a new-style mattress.

Alternatives to completely replacing the bedding designed specifically for previously-conventional mattresses have been suggested. U.S. Pat. No. 4,862,541 discloses a device for attaching a sheet to a mattress. The device comprises an elongate strap with a fastener at each end. The strap is positioned under the corner of a mattress with the two ends of the fastener projecting from beneath the mattress. The two fasteners are attached to adjacent edges of a sheet. U.S. Pat. Nos. 4,782,543 and 4,660,240 disclose devices for fastening sheets and bedding to water beds. These devices are not suited for use with conventional mattresses and must also be separately purchased and installed. U.S. Pat. No. 5,161,276, the disclosure of which is incorporated by reference herein, discloses a device that is included as an integral part of a new, thicker mattress for attaching a sheet to the mattress. This device is preferably installed by the manufacturer during manufacture of the mattress. The attachment device disclosed in U.S. Pat. No. 5,161,276 includes a grommet or other reinforcement structure defining an opening in the border material forming the wall of the mattress, and protecting and reinforcing the material surrounding the opening, as a place for mounting the remainder of the attachment device. A pair of such grommets are installed in the wall of the mattress in the two sides that meet at a corner of the mattress. A rotatable coupler is connected to each grommet and holds one end of a rubber cord which is stretched between the two couplers, around the corner of the mattress.

To facilitate handling of the mattress, handles are attached to the wall at the two sides of the mattress. The two handles are attached to the wall at the two sides of the mattress, and are typically about two to three feet apart so that one person can conveniently grip both handles at one side of the mattress in respective hands.

It is generally recognized that it is desirable that a mattress should be turned from time to time. The mattress may be turned top to bottom and/or head to toe. Even though the mattress has handles at each side, turning the mattress is awkward and, particularly with the new, thicker mattresses that are up to 16 inches thick, and are much heavier than the older conventional mattresses that were approximately 7 inches thick, can be a daunting task.

SUMMARY OF THE INVENTION

In accordance with a first aspect of the invention there is provided an article of manufacture comprising a mattress having first and second main surfaces and a wall that joins the first and second main surfaces, the mattress having a corner at which two edges of the wall meet, a handle having first and second end regions attached to the two edges respectively of the wall adjacent said corner and having a medial portion that wraps around said corner, an elastic cord having first and second end regions attached to the first and second end regions respectively of the handle and having a medial portion that wraps around the corner of the mattress with the medial portion of the handle between the mattress and the medial portion of the cord, and a gripper plate attached to the elastic cord for securing a sheet or blanket to the mattress.

In accordance with a second aspect of the invention there is provided a rectangular mattress having first and second main surfaces and a wall that joins the first and second main surfaces and has four length segments that meet in pairs at respective corners of the mattress, and four handles at the four corners respectively of the mattress, each handle having its two opposite ends attached to the two segments respectively of the wall that meet at the respective corner of the mattress, whereby each handle wraps around a corner of the mattress.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
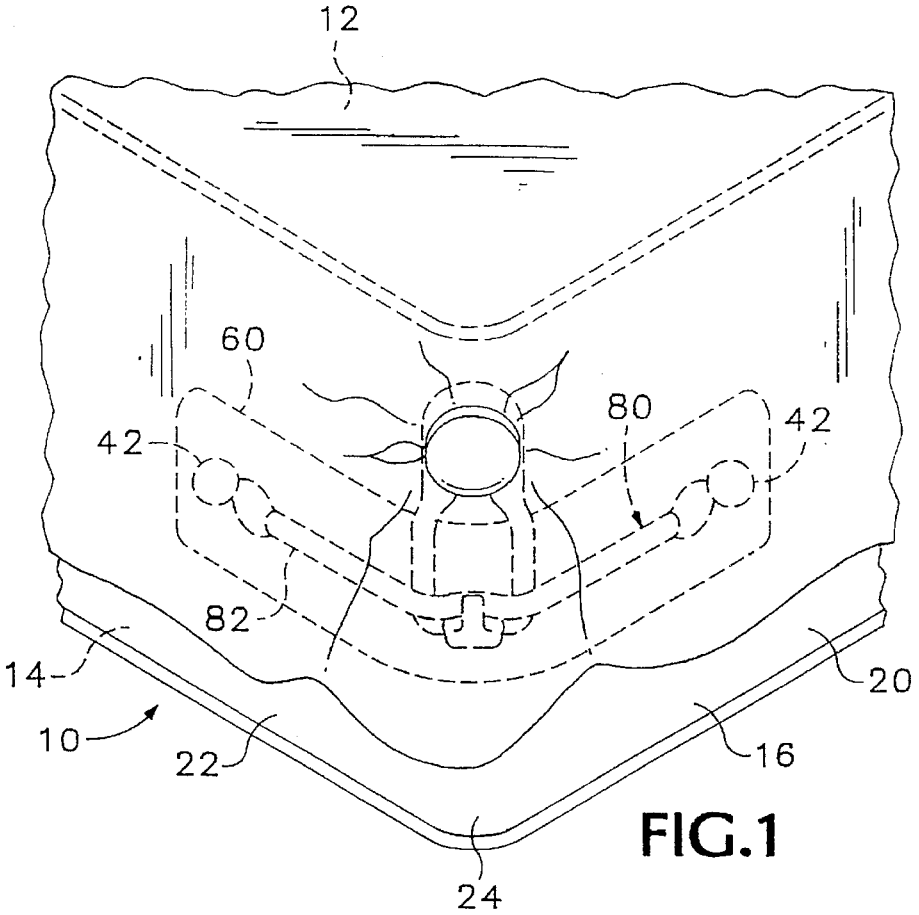
FIG. 1 is a perspective view from above one corner of a mattress equipped at each corner with a handle incorporating a bed sheet attachment device, together with a portion of an installed bed sheet held by the attachment device.
Figure 2:
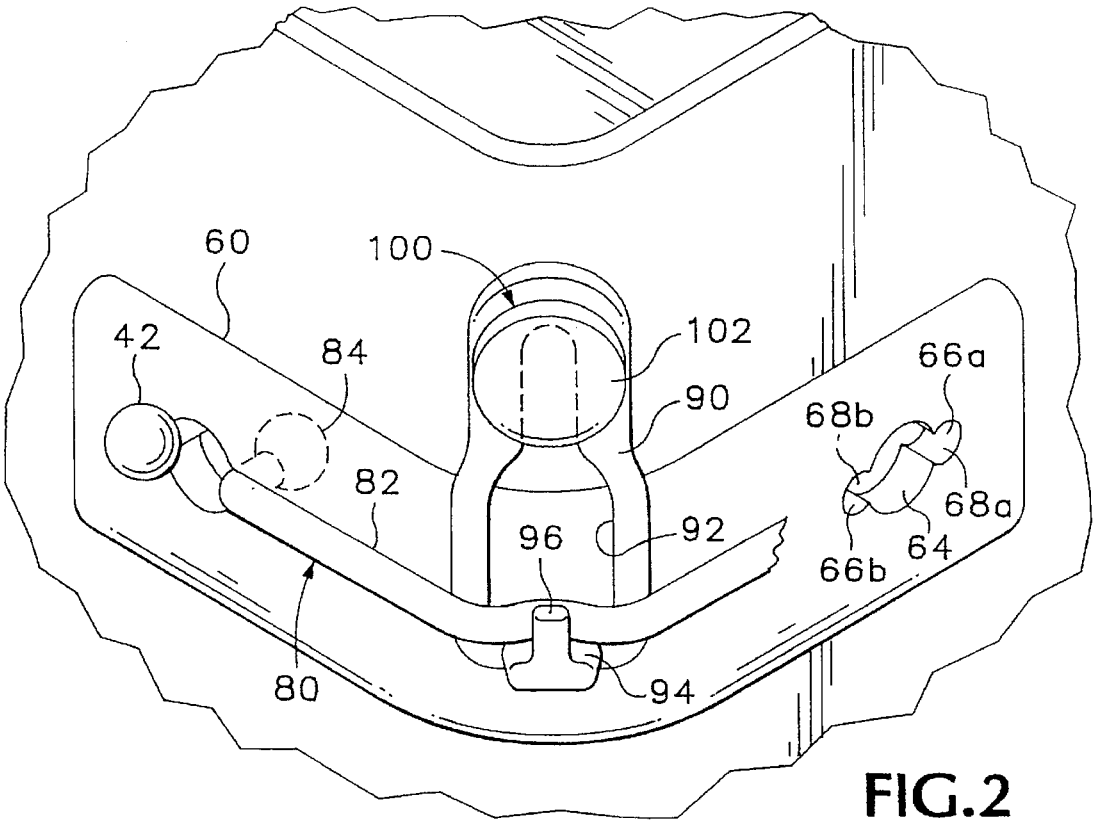
FIG. 2 is an enlarged view similar to FIG. 1 with the sheet removed and with the bed sheet attachment device partially broken away.
Figure 3:
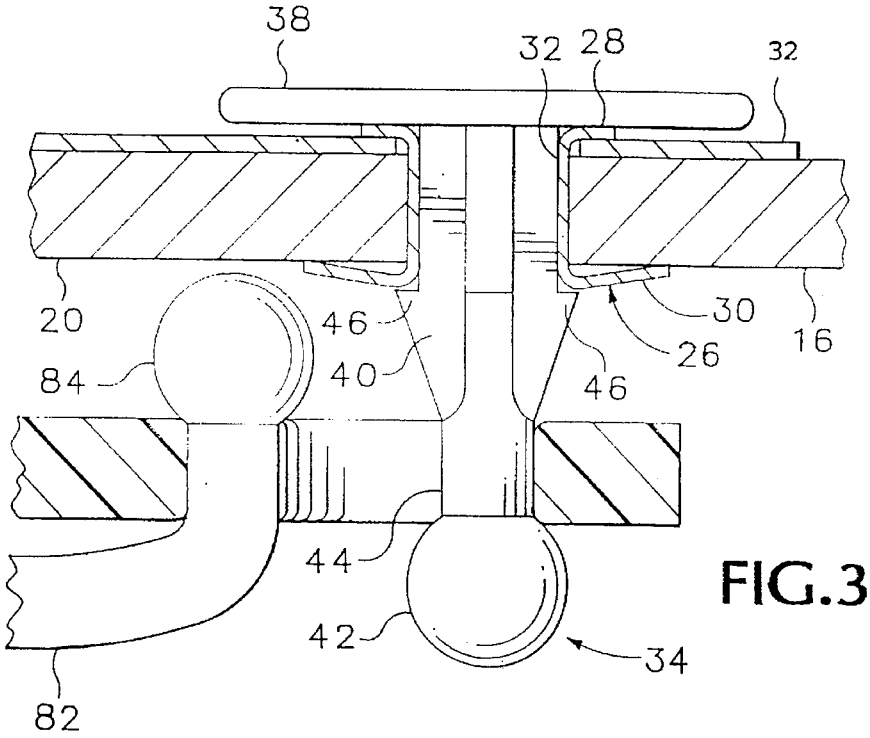
FIG. 3 is an enlarged sectional view illustrating the structure by which the handle is attached to the mattress.

Referring to FIGS. 1–3, a rectangular mattress 10 has a top 12, a wall 14 and a wall 16 that joins the top and bottom. The wall 16 has two edges 20 and 22 that meet at a corner region 24. Referring to FIG. 3, a grommet 26 having an inner flange 28, an outer flange 30 and a hollow cylindrical sleeve 32 joining the inner and outer flanges is installed in the edge 20 about two inches from the corner region 24 and a similar grommet is installed in the edge 22 at a corresponding distance from the corner region 24, so that the two grommets are about five inches apart. A back bar 32 is provided between the wall 16 and the inner flange 28 of the grommet for reinforcing purposes.

The grommet 26 and the back bar 32 are installed in the border material that is used to form the wall of the mattress in conventional manner prior to attachment of the border material to the top and bottom of the mattress. The grommet 26 is approximately half way between the top and bottom of the mattress.

A handle attachment member 34 is attached to the edge 20 of the mattress using the grommet 26. Specifically, the handle attachment member 34 has a flat circular base 38 from which a rod 40 extends. At its end that is farther from the base 38, the rod 40 is formed with a generally spherical knob 42 on a cylindrical segment 44. Between the segment 44 and the base 38, the knob 40 is cross-shaped in section and is formed with retaining barbs 46. The member 34 is attached to the edge 20 of the wall 16 by inserting the rod 40 through the grommet until the barbs 46 are released from the grommet and thereby serve to hold the member 34 in position by engaging the outer flange 30 of the grommet 26.

A handle 60 is made of soft, but nevertheless tough, synthetic polymer material, such as polypropylene or a glass-filled PVC. The handle 60 has two end portions and a medial portion therebetween. In each end portion, the handle 60 is formed with a double keyhole opening having a large circular portion 64 and two smaller circular portions **66*a* and 66*b* at opposite sides of the large circular portion 64 and connected to the large circular portion by respective narrow necks 68*a* and 68*b*. The larger portion 64 is sufficiently large for the knob 42 to pass therethrough, whereas the circular portion 66*a* is smaller than the knob but is slightly larger than the cylindrical segment 44 of the rod 40. One end of the handle 60 is attached to the mattress by inserting the knob 42 through the larger portions of the opening and then forcing the cylindrical portion 44 through the narrow neck 68*a* into the circular smaller portion 66*a*. The other end of the handle is attached in similar fashion to the other handle attachment member. It can be seen from FIGS. 1 and 2** that the medial portion of the handle wraps around the corner of the mattress.

The bed sheet attachment device includes an elastic cord 80 comprising a medial portion 82 of uniform diameter and knobs 84 at each end of the medial portion. The cord 80 is attached to the handle by inserting one of the knobs 82 through the large circular portion 64 and then forcing the medial portion of the cord through the neck **68*b* into the circular portion 66*b*. This operation is repeated at the opposite end of the cord 80. In this manner, the cord 80 is attached to the handle 60 and the cord 80** passes around the corner of the mattress over the handle.

The bed sheet attachment device also comprises a gripper plate 90. The gripper plate may be made of a conveniently formed material such as a tough, rigid synthetic polymer material. The plate has an upper end and a lower end, the words "upper" and "lower" referring to the normal position of the plate when the attachment device is in use, as shown in FIGS. 1 and 2. The plate is generally flat, having opposite sides which are generally parallel, and a thickness which is great enough to supply necessary strength and avoid sharp corners or edges which might tear the sheet, i.e. at least approximately 3/16 inch.

The gripper plate defines an opening 92, which generally resembles a standard keyhole and has a wider portion near the lower end of the plate and a narrower portion near the upper end of the plate. The lower end of the gripper plate includes an integrally molded shelf portion 94 which protrudes forward from the gripper plate and a narrower stub 96 which extends upward at the outer edge of the shelf portion 94 to form a throat area that is narrower than the diameter of the medial portion of the rubber cord. The shelf portion 94 and the stub 96 form a hook that defines a bight for receiving the medial portion of the cord. To ensure that the cord is held securely, the throat area is slightly narrower than the base of the bight, as disclosed in copending U.S. patent application Ser. No. 08/624,020 filed Mar. 27, 1996, the disclosure of which is hereby incorporated by reference herein.

A final component of the bed sheet attachment device is a stud 100, which includes a circular base portion 102 having a diameter greater than the width of the wider portion of the opening 92, a circular head portion having a diameter intermediate between the width of the narrower portion of the opening 92 and the width of the wider portion of the opening 92, and an interconnecting neck portion whose diameter is slightly smaller than the width of the narrower portion of the opening 92. Since the diameter of the head portion is smaller than the width of the wider portion of the opening 92, and because the width of the opening 92 is greater than the diameter of the neck, the stud may be fitted into the opening 92 in the plate member as shown in FIGS. 1 and 2, with portions of the sheet extending around the head and neck, as shown and described in U.S. Pat. No. 5,161,276. Sufficient clearance is provided between the neck and the interior of the opening 92 to receive the sheet and hold it securely when the neck of the stud is located within the opening 92 near the upper end thereof. The head of the stud is shaped to avoid unnecessarily stressing a sheet held by the attachment device.

To attach the bed sheet to the corner of a mattress into which the attachment device has been installed, the sheet is draped over the gripper plate 90. The head of the stud is pushed through the wider portion of the opening 92 in the gripper plate, pushing a small part of the sheet through the opening. The stud is then slid into the narrower portion of the opening with the sheet surrounding the neck portion. When the plate and the stud have been optimally positioned with respect to the sheet, the rubber cord is stretched across the hook and forced through the throat area defined by the stub 96. In this manner, the cord is held securely in the bight defined by the shelf 94 and the stub 96. The same process is repeated at each corner of the mattress. When the sheet has been attached to the mattress in this fashion, only the base 102 of each of the studs will be visible, and even the base will ordinarily be out of view between the mattress and the rest of the bedding on the bed. Thus, the attachment device is used in the manner described in U.S. Pat. No. 5,161,276 for attaching an article of bedding, such as a sheet, to the mattress, as shown in FIG. 1.

Figure 4:
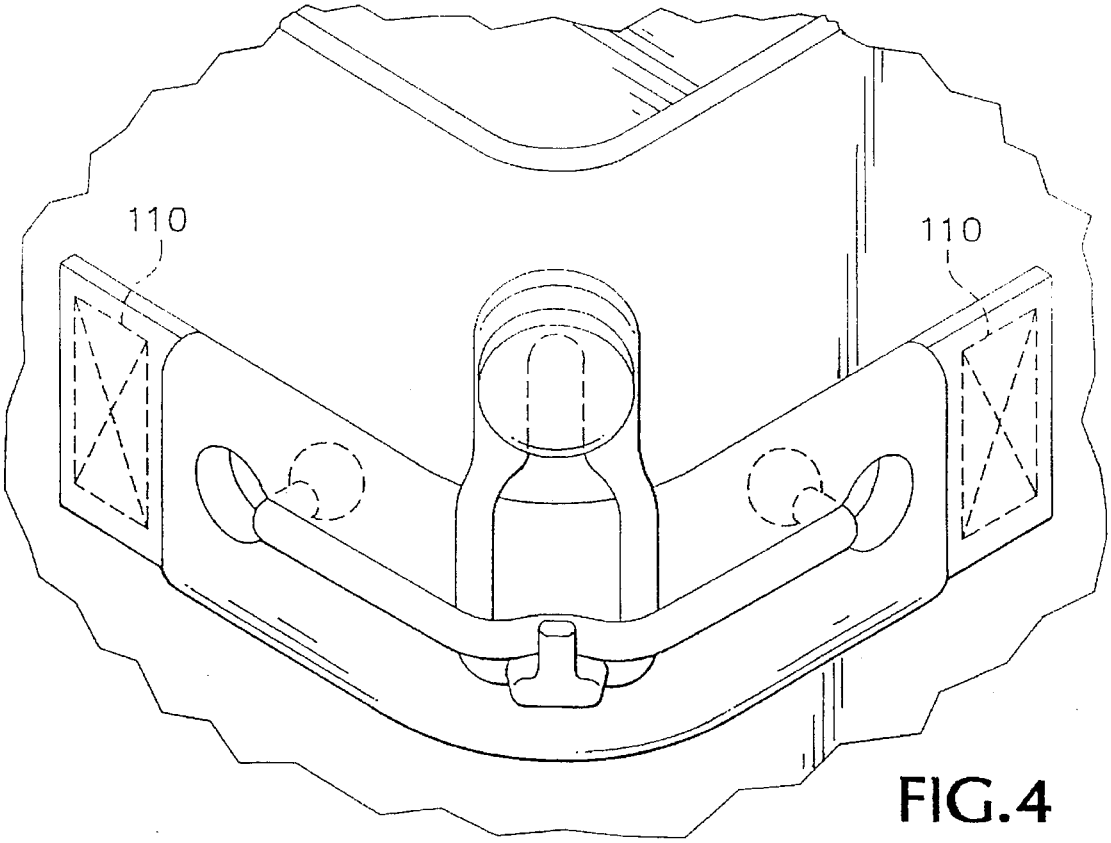
FIG. 4 is a view similar to FIG. 2 illustrating a modification of the handle.

FIG. 4 shows a modification in which the two opposite ends of the handle are attached to the wall of the mattress by stitching as shown at 110 instead of using attachment members of the type shown in FIG. 3. In the case of FIG. 4, the hole at each end of the handle has a large circular portion 64 and one smaller circular portion connected to the large circular portion by a narrow neck, for receiving the elastic cord.

Figure 5:
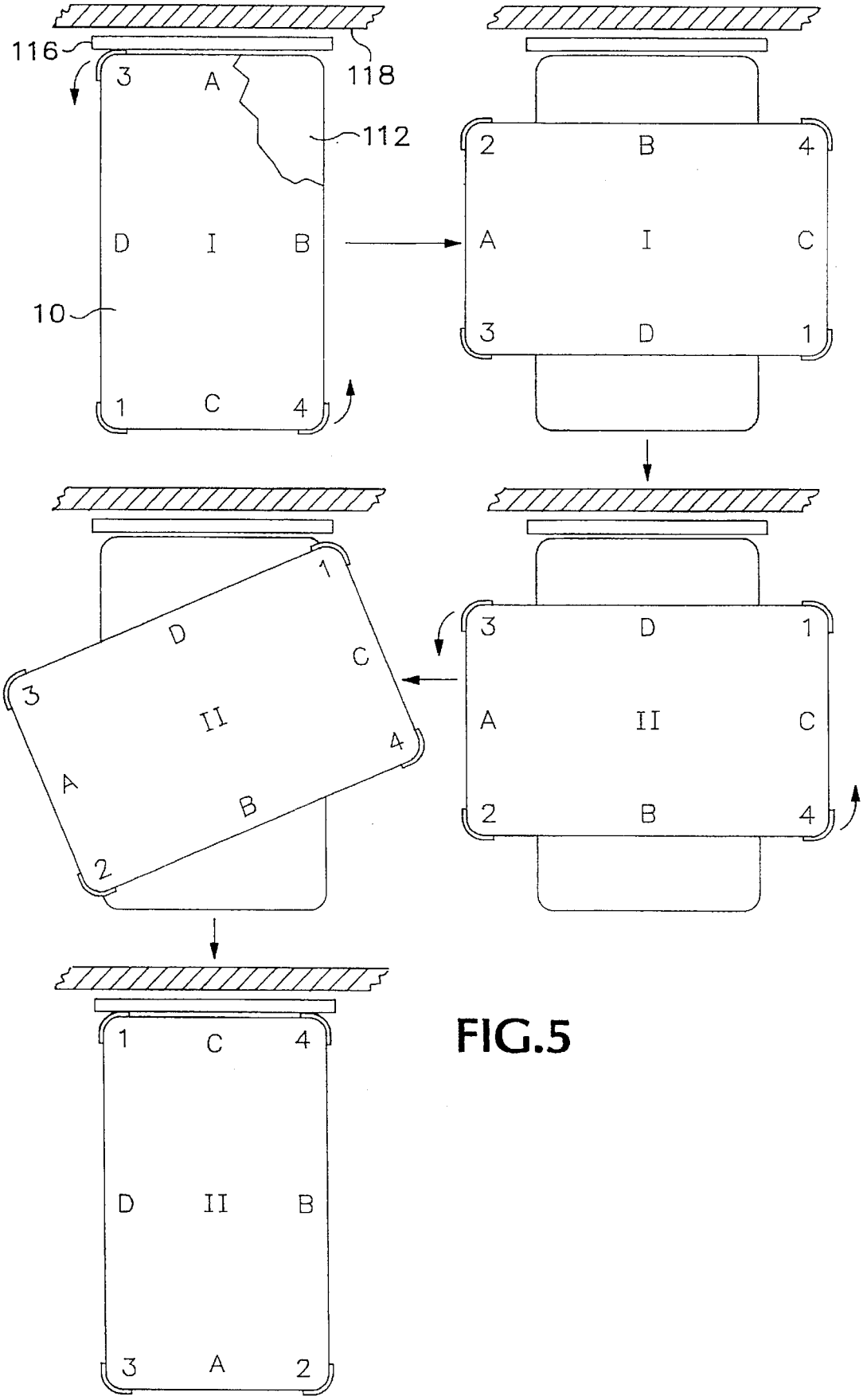
FIG. 5 illustrates the procedure for turning a mattress equipped with handles at the corners.

FIG. 5 shows the mattress 10 having handles at its four corners placed on a boxspring with the head 116 of the bed against a wall 118.

Placement of the handles at the corners of the mattress provides significant advantages in handling the mattress, and in particular in turning the mattress. Referring to FIG. 5, if the edge A is at the head of the bed and the surface I is at the top, the mattress can be readily turned side to side and head to foot by the following procedure. Two people grasp the handles at the corners 3 and 4 respectively and lift the mattress and the turners walk in the direction indicated by the respective arrows so that the mattress is turned through 90° about a vertical axis and deposit the mattress on the box spring. The turners then grasp the handles at the corners 2 and 4 and lift the edge B over the edge D, while pulling the edge D toward the head of the bed, and deposit the mattress with the edge B toward the foot of the box spring. The turners then grasp the handles at the corners 3 and 4 and lift the mattress from the box spring and walk in the directions of the respective arrows. It is then relatively simple to slide the corner 1 to the left of FIG. 5 and the corner 2 to the right, while the mattress rests on the box spring, and bring the mattress to the position in which the edge C is at the head and the surface II is at the top. By this rather simple sequence, the mattress is turned head to toe and top to bottom. It is even simpler and easier to turn the mattress head to toe only or top to bottom only. It will, of course, be appreciated that there will be a tendency when the corners 3 and 4 are lifted for the corners 1 and 2 to sag somewhat, but the new, thicker mattresses are quite stiff and this sagging does not interfere with the operations to be performed by the turners.

It will be appreciated that the invention is not restricted to the particular embodiment that has been described, and that variations may be made therein without departing from the scope of the invention as defined in the appended claims and equivalents thereof.

We claim:

1. An article of manufacture comprising:

a mattress having first and second main surfaces and a wall that joins the first and second main surfaces, the mattress having a corner at which two edges of the wall meet, a handle having first and second end regions attached to the two edges respectively of the wall adjacent said corner and having a medial portion that wraps around said corner, an elastic cord having first and second end regions attached to the first and second end regions respectively of the handle and having a medial portion that wraps around the corner of the mattress with the medial portion of the handle between the mattress and the medial portion of the cord, and a gripper plate attached to the elastic cord for securing a sheet or blanket to the mattress.

2. An article according to claim 1, wherein the handle is formed with first and second openings in its first and second end regions respectively, the elastic cord comprises a medial portion of substantially uniform diameter and enlarged knobs at the first and second end regions respectively, and the first and second end regions of the cord are attached to the first and second end regions of the handle by insertion of the knobs through the respective openings.

3. An article according to claim 2, wherein each opening has a larger diameter portion and a smaller diameter portion connected together by a neck portion, and the knob is smaller than the larger diameter portion but is larger than the smaller diameter portion, whereby the end region of the cord can be attached to the end region of the handle by inserting the knob through the large diameter portion of the opening and forcing the medial portion of the cord through the neck into the smaller diameter portion of the opening.

4. An article according to claim 1, comprising an attachment member attaching the first end region of the handle to an edge of the mattress, wherein the mattress is formed with a hole in the wall and the attachment member comprises a rod portion that extends through the hole in the mattress wall between an interior surface of the wall and an exterior surface thereof, a plate member at one end of the rod, and the other end of the rod being attached to the first end region of the handle.

5. An article according to claim 4, wherein the handle is formed with an opening at its first end region, the opening having a larger diameter portion and a smaller diameter portion connected together by a neck, and the rod has a cylindrical portion and a knob at said second end thereof, the knob being smaller than the larger diameter portion of the opening and larger than the smaller diameter portion thereof, whereby the first end region of the handle is attached to the mattress by insertion of the knob through the larger diameter portion of the opening and sliding the cylindrical portion of the rod through the neck of the opening into the smaller diameter portion thereof.

* * * * *